United States Patent [19]

Nishida

[11] Patent Number: 4,582,039

[45] Date of Patent: Apr. 15, 1986

[54] FUEL SUPPLY SYSTEM FOR AN INTERNAL COMBUSTION ENGINE

[75] Inventor: Hiroshi Nishida, Miki, Japan

[73] Assignee: Kawasaki Jukogyo Kabushiki Kaisha, Kobe, Japan

[21] Appl. No.: 677,196

[22] Filed: Dec. 3, 1984

[30] Foreign Application Priority Data

Dec. 6, 1983 [JP] Japan ..... 58-229209

[51] Int. Cl.[4] ..... F02M 59/00

[52] U.S. Cl. ..... 123/510; 123/514

[58] Field of Search ..... 123/514, 510, 511, 512, 123/513

[56] References Cited

U.S. PATENT DOCUMENTS

| | | | |
|---|---|---|---|
| 1,304,550 | 5/1919 | Edison, Jr. | 123/510 |
| 1,305,037 | 5/1919 | Vinient | 123/510 |
| 1,348,406 | 8/1920 | Green | 123/510 |
| 1,404,152 | 1/1922 | Kettering | 123/510 |
| 1,424,486 | 8/1922 | Kinzie | 123/510 |
| 1,712,492 | 5/1929 | Dienner | 123/510 |
| 1,957,754 | 5/1934 | Berdon | 123/510 |
| 3,747,903 | 7/1973 | Phelps | 123/510 |

FOREIGN PATENT DOCUMENTS

| | | | |
|---|---|---|---|
| 493051 | 10/1917 | France | 123/510 |

*Primary Examiner*—Magdalen Y. C. Moy

*Attorney, Agent, or Firm*—Marshall, O'Toole, Gerstein, Murray & Bicknell

[57] ABSTRACT

This disclosure relates to a fuel supply system for an internal combustion engine, wherein a suction type fuel supply system supplies fuel through a fuel pump to a carburetor which is located at a level higher than the fuel level of the main fuel tank. In one disclosed embodiment, a reserve fuel tank is provided on the line connecting the main fuel tank with the fuel pump, and the reserve tank is at a level higher than the carburetor and the fuel pump, the fuel outlet of the reserve tank is located at a level lower than the fuel inlet. According to an alternative embodiment, a fuel supply system is provided wherein a suction type fuel supply system supplies fuel through a fuel pump to a carburetor which is located at a level higher than the fuel level of the main fuel tank. The supply line between the fuel pump and the carburetor is branched and forms a return circuit leading to the upstream side of the fuel pump, and a reserve fuel tank is installed in the return circuit at a level above the carburetor and the fuel pump. A standby outlet connected to the upstream side of the reserve tank is provided at a level below the outlet of said reserve tank, and the flow through the inlet of the reserve tank and the standby outlet can be switched over from one to the other.

11 Claims, 3 Drawing Figures

FUEL SUPPLY SYSTEM FOR AN INTERNAL COMBUSTION ENGINE

The present invention relates to apparatus for supplying fuel from a fuel tank to a carburetor of an engine, and more particularly, it relates to the construction of a fuel supply system of the suction type wherein the carburetor is located at a higher level than the fuel tank and fuel is fed by a fuel pump.

BACKGROUND OF THE INVENTION

In the art of relatively small gasoline engines, it has been commonplace to mount the fuel tank higher than the carburetor so that there can be a gravity feed of the fuel to the carburetor. There are some types, however, where it is desirable to place the fuel tank lower than the carburetor, and in this instance a pump is needed to convey the fuel. For example, in the recreational water vehicle known as the Jet Ski (a registered trademark owned by the present assignee) which has a shallow bottom, the fuel tank should be installed at a low level to avoid a high center of gravity and the resulting instability, and the carburetor of the engine is generally at a point higher than the fuel level in the tank.

As another example, in large-tired tricycles (or buggies) which are required to have the capability to run in swamp or bog areas and the like, it is necessary to install the carburetor at a high level, which also results, in many cases, in the fuel level being lower than the carburetor.

Fuel supply systems for the above vehicles cannot, of course, be of a gravity supply type, and a suction type fuel supply system in which a fuel pump is provided between the fuel tank and the carburetor is normally used. FIG. 1 illustrates a typical prior art suction type fuel supply system. In FIG. 1, the curburetor 2 of the engine 1 is installed at a higher level than the fuel tank 3, and the feed of fuel to said carburetor is effected by the suction of a fuel pump 4. Connected in the fuel line between the fuel tank 3 and the fuel pump 4 are a change-over valve 5 and a filter 6, and the valve 5 and the fuel tank 3 are connected to each other by two supply lines 7A and 7B which have suction ends at different levels in the tank 3. When the fuel level in the fuel tank 3 is at or above the higher level A, the valve 5 is operated to connect the supply line 7A to the pump 4, and when the fuel level drops below the level A, the valve 5 is operated to connect to the supply line 7B (reserve line) having the lower suction end. The level B is the level of the suction end of the supply line 7B (or the minimum level). Fuel between the level A and the level B is used as the reserve fuel.

The supply line from the fuel pump 4 to the carburetor 2 is branched, one branch leading to the carburetor 2 and the branch 8 being connected to an upper level in the fuel tank 3 and constituting a return circuit.

In the prior art system of FIG. 1 described above, if the engine were turned off for an extended period (e.g., for several days or a week), the fuel initially filling the supply line up to the carburetor may evaporate or drain out. This would cause air or fuel vapor to fill the space in the fuel supply line, and the resulting condition of the system would be such that, without priming, it would be difficult to pump up the fuel in order to restart the engine, which would, in turn, result in a longer startup time and increased battery load. In particular, if the engine pulses such as negative pressure fluctuations in the crankcase were used to operate the fuel pump 4, the startup problems would be more pronounced due to small discharge of the pump during the startup when the engine turns over slowly.

It is a primary objective of the present invention to avoid the aforementioned problems encountered with the conventional fuel supply systems and to provide a fuel supply system which can easily and quickly supply fuel to the carburetor even if the engine is started with air or vapor in the supply system, to achieve easy startup.

BRIEF SUMMARY OF THE INVENTION

The present invention achieves the aforementioned objective by providing a reserve fuel tank at a level higher than the carburetor and the fuel pump.

In accordance with the present invention a fuel supply system is provided, wherein a suction type fuel supply system supplies fuel through a fuel pump to a carburetor which is located at a level higher than the fuel level of the fuel tank. A reserve fuel tank is provided on the line connecting the fuel tank and the fuel pump, and the reserve tank is at a level higher than the carburetor and the fuel pump, the fuel outlet of the reserve tank being located at a level lower than the fuel inlet.

Further, according to an alternative form of the present invention, a fuel supply system is provided wherein a suction type fuel supply system supplies fuel through a fuel pump to a carburetor which is located at a level higher than the fuel level of the fuel tank. The supply line between the fuel pump and the carburetor is branched and forms a return circuit leading to the upstream side of the fuel pump, and a reserve tank is installed in the return circuit at a level above the carburetor and the fuel pump. A standby outlet connected to the upstream side of the reserve tank is provided at a level below the outlet of said reserve tank, and the flow through the inlet of the reserve tank and the standby outlet can be switched over from one to the other.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
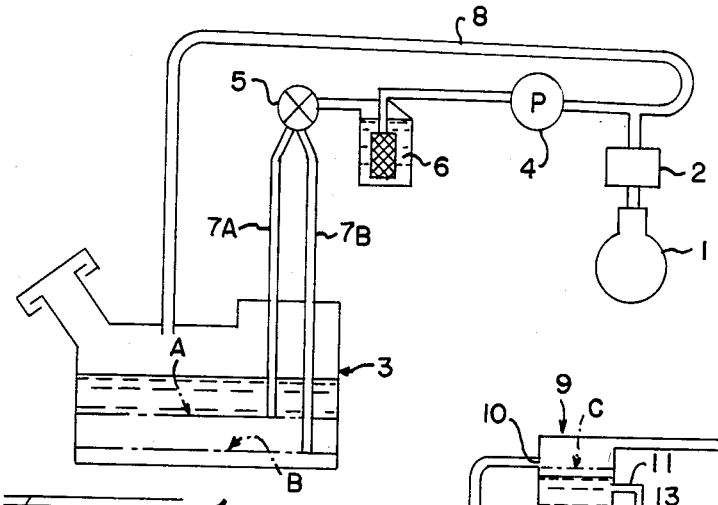
FIG. 1 PRIOR ART
FIG. 1 is a schematic diagram illustrating a prior art fuel supply system.
Figure 2:
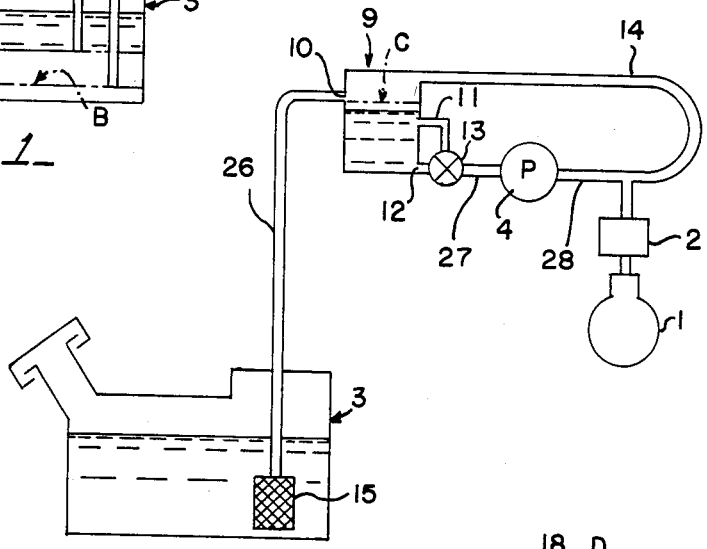
FIG. 2 is a schematic diagram illustrating one embodiment of a fuel supply system according to the present invention.

In the system shown in FIG. 2, a carburetor 2 of an engine 1 is installed at a level which is above the fuel level of a main fuel tank 3, and the fuel is supplied to the carburetor by the suction of a fuel pump 4.

A fuel line 26 is connected between a filter 15 located in the fuel tank 3 and the inlet 10 of a reserve fuel tank 9. The reserve tank 9 is installed between the fuel tank 3 and the fuel pump 4 at a level which is above the carburetor 2 and the fuel pump. The inlet 10 of the reserve tank 9 is formed at a point corresponding to the highest fuel level C in the tank 9, and there are two outlets 11 and 12 of the reserve tank which are formed at two different elevations below the highest fuel level C. The two outlets 11 and 12 are connected to two intakes of a change-over valve 13, and the outlets are arranged to be switched over from one to the other by turning the valve.

The outlet of the valve 13 is connected by a line 27 to the intake of the pump 4, and the output of the pump is connected by another line 28 to the intake of the carburetor 2. A return line or circuit 14 leading to another intake of the reserve tank 9 is branched from the line 28 between the fuel pump 4 and the carburetor 2. This return circuit 14 is connected to the reserve tank 9 at a point which is above the highest fuel level C.

The fuel pump 4 may be a conventional type and is driven when the engine 1 is running. The pump may be powered by engine-produced pulses (such as pressure fluctuations in the crankcase), or by a mechanical transmission system.

The main fuel tank 3 is vented or open to the atmosphere, whereas the reserve tank 9 has a sealed construction. Accordingly, when the fuel level in the reserve tank 9 drops due to the flow of fuel to the carburetor, a negative pressure, or partial vacuum, will be created, and this negative pressure will suck up fuel in the line 26 from the fuel tank 3.

In the construction illustrated in FIG. 2, the filter 15 is mounted on the lower end of the suction line 26 in the fuel tank 3. This filter, however, may be installed at other locations such as at a point near the inlet 10 of the reserve tank 9.

In operation, when the engine 1 is running, the change-over valve 13 is normally set such that the fuel flows through the upper outlet 11 to the pump 4 and the lower outlet 12 is closed. Under this condition, the fuel in the reserve tank 9 is fed through the fuel pump 4 to the carburetor 2, and the fuel in the fuel tank 3 is sucked up by a negative pressure produced in the reserve tank 9 resulting from the pump operation and the feed of the fuel; thus the fuel is continuously fed to the carburetor 2. Since the discharge of the fuel pump 4 is designed to be a little greater than the fuel consumption of the carburetor 2, any excessive volume of fuel is circulated back to the reserve tank 9 via the return circuit 14.

When the engine 1 has been turned off for an extended time and there is little or no fuel present in the supply lines to the carburetor due to evaporation or drainage of fuel, or when the fuel level in the tank 9 is below the upper outlet 11 (whether such conditions actually exist or are suspected to be present), the engine is started by turning the change-over valve 13 to the position where the fuel is able to flow through the lower outlet 12 and the passage is closed to the upper outlet 11. With this condition, even after an extended inactivity of the engine, the fuel in the reserve tank between the outlets 11 and 12 can be introduced into the fuel pump 4 and/or the carburetor 2 instantly by turning the valve 13 to the outlet 12; thus the fuel pump 4 will operate properly, due to the so-called priming effect, to achieve an easy and rapid flow of fuel to the carburetor 2.

Since the fuel above the lower outlet 12 is available to be used during startup, the engine can be started with ease even though the pump delivery volume is low due to a low turn-over rate of the engine; thus the startup difficulties encountered with conventional fuel systems can be eliminated.

After a successful startup, when the operation of the fuel pump 4 is normal, the change-over valve 13 is returned to the other position where the fuel passes through the upper outlet 11 and the line 26. The fuel level in the reserve tank 9 will be gradually restored to the normal level C of the intake 10. When the fuel supply from the pump 4 exceeds the engine consumption, the excess fuel will be returned to the reserve tank 9 through the return circuit 14. The reserve quantity in the reserve tank 9 may be set, for example, at one to two liters.

In the construction described above, vertically spaced upper and lower outlets 11 and 12 are provided in the reserve tank 9 and these outlets are arranged to be switched by the change-over valve 13. In some cases, a similar effect can be achieved by providing one single outlet and eliminating the use of a change-over valve. In other words, in the system shown in FIG. 2, the outlet 12 and the valve 13 may be eliminated if the fuel level can be maintained fairly high above the outlet 11 not only during normal operation but also after an extended shutdown of the engine. Thus, by locating the outlet 11 of the reserve tank 9 below the inlet 10 by a sufficient distance, a similar effect can be achieved by using the fuel stored in the reserve tank above said outlet 11 during startup. Alternatively, the outlet 11 and the valve 13 may be eliminated and the operation would be similar when using the outlet 12.

Figure 3:
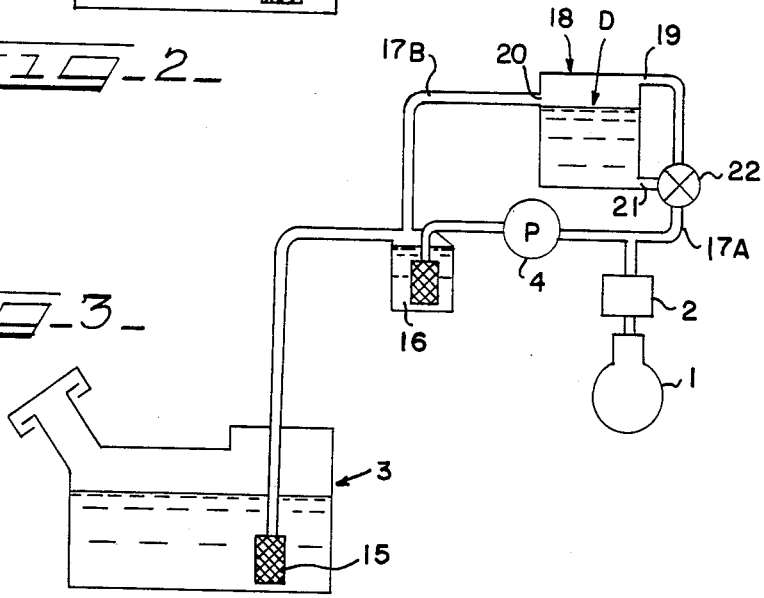
FIG. 3 is a schematic diagram illustrating a second embodiment of a fuel supply system according to the present invention.

In the system shown in FIG. 3, a carburetor 2 of an engine 1 is installed at a level higher than the fuel level of a main fuel tank 3, and the supply of fuel to said carburetor is effected by the suction of fuel pump 4, similar to the system of FIG. 2. A pot-type filter 16 is provided between the fuel tank 3 and the fuel pump 4.

The supply line between the fuel pump 4 and the carburetor 2 is branched, and in the embodiment illustrated, a return circuit including lines 17A and 17B are provided for returning fuel back to the above-mentioned pot-type filter 16 which is provided on the upstream side of the fuel pump 4. In the middle of this return circuit (between the lines 17A and 17B) is connected a reserve tank 18 which is located at a level higher than the carburetor 2 and the fuel pump 4.

The reserve tank 18 includes, in addition to an inlet 19 and an outlet 20, a standby outlet 21 below the outlet 20. The inlet 19 is at an upper level, the outlet 21 is at a low level, and the outlet 20 is at an intermediate level on the tank 18. The standby outlet 21 is connected to the line 17A on the upstream side of the tank 18, and a change-over valve 22 is provided at the junction of the outlet 21 with the line 17A for connecting the line 17A to either the inlet 19 or the standby outlet 21. During normal running operation, the change-over valve 22 is set in such a way that the line 17A is connected to the inlet 19 but the line 17A is disconnected from the standby outlet 21.

The fuel pump is operated simultaneously with the engine 1, and is driven by appropriate means such as engine pulses (e.g., pressure fluctuations in the crankcase) or a mechanical transmission system. In the example illustrated in FIG. 3, the suction end of the fuel line in the fuel tank is also provided with a filter 15. It is possible to use the above-mentioned pot-type filter 16 alone, and the filter 15 in the fuel tank may be dispensed with.

When the fuel in the lines is in the normal condition, the change-over valve 22 is set to connect the line 17A to the inlet 19, and the surplus fuel of the output of the fuel pump 4 flows through the line 17A into the reserve tank 18 through the inlet 19. When the fuel in said reserve tank becomes excessive, it reaches the level D of the outlet 20 and is returned from the outlet 20 back to the pot-type filter 16 via the line 17A, and then sent out to the pump 4 again. Accordingly, the normal fuel level D in the reserve tank 18 is determined by the elevation of the outlet 20. Since this normal fuel level D cannot be raised higher than the level shown, it is at the maximum level. The fuel between this normal level D and the above-mentioned standby outlet 21 (in the case illustrated, the outlet 21 is placed at the same level as the bottom of the reserve tank) is the reserve fuel supply.

When the engine is to be started after a passage of a considerable time (e.g., several days to one week) after the stoppage of the engine, the fuel pump 4 may not be able to pump up the fuel because of air or fuel vapor in the fuel supply line due to evaporation or drainage of fuel which initially filled the lines up to the carburetor. When such a problem is experienced or anticipated, the engine is started (and the fuel pump is driven) only after the operator turns the change-over valve 22 to connect the standby outlet 21 to the line 17A leading to the carburetor 2.

Consequently with the construction and operation described in connection with FIG. 3, even after an extended shutdown of an engine, the fuel in the reserve tank 18 between the outlets 20 and 21 can be introduced into the fuel pump 4 and/or the carburetor 2 instantly by turning the change-over valve 22; thus the fuel pump 4 will operate properly, due to the so-called priming effect, to achieve an easy and rapid feed of fuel to the carburetor.

Since the reserve fuel in the reserve tank 18 can be effectively used during the engine startup, the engine can be started easily even if the pump delivery rate is low due to a small number of revolutions of the engine; thus the startup difficulties of conventional type systems can be avoided. After a successful startup, when the operation of the fuel pump 4 is normal, the change-over valve 22 is turned to establish the normal operation. The fuel level in the reserve tank 18 will be restored to the original or normal level of the outlet 20 by the operation of the pump and the flow of excess fuel to the inlet 19.

The reserve fuel quantity in the reserve tank 18 may be designed to be, for example, one to two liters.

As is evident from the foregoing description, the present invention provides a fuel supply system which permits rapid startup of the engine even if air or fuel vapor is present in the fuel supply line to the carburetor due to an extended shutdown of the engine, or for other reasons, by assuring a ready supply of fuel to the carburetor.

While the description and the claims include references to the locations of parts relative to other parts, such as above or below, it will be understood that such references are used to facilitate the description of the apparatus during normal use and that the apparatus may have other orientations during, for example, construction and shipping.

What is claimed is:

1. A fuel supply system for an internal combustion engine, comprising:

a. a main fuel tank;

b. a carburetor located at a higher level than the fuel level of said main fuel tank;

c. a first fuel line connected to said main fuel tank and adapted to extend into the fuel in said main fuel tank;

d. a pump having an intake operatively connected to said first fuel line, said pump further having an output connected to said carburetor;

e. a second fuel line connected to said pump output;

f. a reserve fuel tank having a first fuel inlet and a first fuel outlet which is at a lower level than said first fuel inlet, said reserve fuel tank being at a higher level than said carburetor, said first fuel outlet being operatively connected to said carburetor, and said first fuel inlet being connected to one of said first and second fuel lines; and g. a control valve connected between said first fuel outlet and said carburetor.

2. A system according to claim 1, wherein said first fuel inlet of said reserve tank is connected to said first fuel line, and said first fuel outlet is connected through said pump to said carburetor.

3. A system according to claim 2, wherein said reserve fuel tank further includes a second fuel inlet connected to said second fuel line.

4. A system according to claim 1, wherein said reserve fuel tank further includes a second fuel outlet operatively connected to said intake of said pump.

5. A system according to claim 1, wherein said pump is a suction type.

6. A system according to claim 1, wherein said first fuel inlet of said reserve tank is connected to said second fuel line and to said carburetor.

7. A fuel supply system for an internal combustion engine, comprising:

a. a main fuel tank;

b. a carburetor located at a higher level than the fuel level of said main fuel tank;

c. a first fuel line connected to said main fuel tank and adapted to extend into the fuel in said main fuel tank;

d. a pump having an intake operatively connected to said first fuel line, said pump further having an output connected to said carburetor;

e. a reserve fuel tank having an inlet and an outlet, said outlet being located at a higher level than said carburetor and being operatively connected to said carburetor, and said inlet being operatively connected to said pump output; and f. a control valve connected between said outlet and said carburetor.

8. A fuel supply system comprising a main fuel tank, a suction type fuel pump, a carburetor located at a level higher than the fuel level of said main fuel tank, said carburetor being connected to receive fuel from said pump, a reserve fuel tank located at a level higher than said carburetor and said fuel pump, said reserve fuel tank having an inlet operatively connected to said main fuel tank and an outlet operatively connected to said pump, a control valve connected between said outlet and said pump, and said outlet of said reserve fuel tank being located at a level below said inlet of said reserve fuel tank.

9. A fuel supply system comprising a main fuel tank, a suction type fuel pump, a carburetor located at a level higher than the fuel level of said main fuel tank, said carburetor being connected to receive fuel from said pump, a reserve fuel tank located at a level higher than said carburetor and said fuel pump, said reserve fuel tank having an inlet operatively connected to said main fuel tank and an outlet operatively connected to said pump, and said outlet of said reserve fuel tank being located at a level below said inlet of said reserve fuel tank, said reserve fuel tank being provided with two outlets, including said first-mentioned outlet, said two outlets being at upper and lower points, and a valve connected to said outlets for changing over one from the other.

10. A fuel supply system comprising a main fuel tank, a suction type fuel pump, a curburetor located at a level higher than the fuel level of said main fuel tank, said carburetor being connected to receive fuel from said pump, a reserve fuel tank located at a level higher than said carburetor and said fuel pump, said reserve fuel tank having an inlet operatively connected to said main fuel tank and an outlet operatively connected to said pump, and said outlet of said reserve fuel tank being located at a level below said inlet of said reserve fuel tank, and a supply line between said fuel pump and said carburetor, said supply line including a return circuit branch leading from said pump to said reserve fuel tank.

11. A fuel supply system comprising a main fuel tank, a suction type fuel pump, a carburetor located at a level higher than the fuel level of said main fuel tank and connected to the outlet of said fuel pump, a supply line connected between said fuel pump and said carburetor and branched to also form a return circuit returning to the upstream side of said fuel pump, and a reserve fuel tank is installed in said return circuit at a level above said carburetor and said fuel pump, said reserve fuel tank including a standly outlet at the upstream side of said reserve tank and a main outlet at a level which is above said standby outlet, said reserve fuel tank further comprising an inlet connected to said branch of said return circuit, and means for switching between said inlet of said reserve fuel tank and said standby outlet.

* * * * *